US007766269B2

(12) United States Patent
Gingras

(10) Patent No.: US 7,766,269 B2
(45) Date of Patent: Aug. 3, 2010

(54) REFINER STATOR PLATE HAVING AN OUTER ROW OF TEETH SLANTED TO DEFLECT PULP AND METHOD FOR PULP DEFLECTION DURING REFINING

(75) Inventor: Luc Gingras, Lake Oswego, OR (US)

(73) Assignee: Andritz Inc., Glens Falls, NY (US)

( * ) Notice: Subject to any disclaimer, the term of this patent is extended or adjusted under 35 U.S.C. 154(b) by 505 days.

(21) Appl. No.: 11/746,935

(22) Filed: May 10, 2007

(65) Prior Publication Data

US 2007/0205314 A1 Sep. 6, 2007

Related U.S. Application Data

(62) Division of application No. 11/357,027, filed on Feb. 21, 2006, now Pat. No. 7,472,855.

(60) Provisional application No. 60/743,108, filed on Jan. 9, 2006.

(51) Int. Cl.
*B02C 7/04* (2006.01)

(52) U.S. Cl. ..... 241/261.3; 241/296

(58) Field of Classification Search ..... 241/361.2, 241/296, 297, 298
See application file for complete search history.

(56) References Cited

U.S. PATENT DOCUMENTS

| | | | | |
|---|---|---|---|---|
| 100,537 | A * | 3/1870 | Loy | 241/261.3 |
| 4,023,737 | A * | 5/1977 | Leider et al. | 241/261.3 |
| 4,090,672 | A * | 5/1978 | Ahrel | 241/261.1 |
| 4,676,440 | A * | 6/1987 | Perkola | 241/261.3 |
| 5,181,664 | A * | 1/1993 | Kohler | 241/261.3 |
| 5,683,048 | A * | 11/1997 | Virving | 241/261.2 |
| 5,704,559 | A * | 1/1998 | Froberg et al. | 241/261.3 |
| 5,875,982 | A * | 3/1999 | Underberg | 241/261.3 |
| 6,402,071 | B1 * | 6/2002 | Gingras | 241/261.2 |
| 6,422,496 | B1 | 7/2002 | Doelle | |
| 6,616,078 | B1 * | 9/2003 | Gingras | 241/261.2 |
| 6,926,216 | B2 * | 8/2005 | Healey | 241/252 |
| 2002/0185560 | A1 * | 12/2002 | Johansson | 241/298 |
| 2006/0289689 | A1 * | 12/2006 | Matthew | 241/298 |

* cited by examiner

*Primary Examiner*—Faye Francis
(74) *Attorney, Agent, or Firm*—Nixon & Vanderhye P.C.

(57) ABSTRACT

A refiner including: a rotor disc including a rotor plate including concentric rows of rotor teeth; a stator disc arranged opposite to the rotor disc, wherein the stator disc includes a stator plate; the stator plate includes concentric rows of stator teeth intermeshing with the rows of rotor teeth, and the rows of stator teeth include an outer row of stator teeth having leading sidewalls angled to deflect particles flowing between the teeth of the outer row.

11 Claims, 5 Drawing Sheets

REFINER STATOR PLATE HAVING AN OUTER ROW OF TEETH SLANTED TO DEFLECT PULP AND METHOD FOR PULP DEFLECTION DURING REFINING

CROSS RELATED APPLICATIONS

This application is a divisional of application Ser. No. 11/357,027 filed Feb. 21, 2006 now U.S. Pat. No. 7,472,855 and claims the benefit of provisional application Ser. No. 60/743,108, filed Jan. 9, 2006, both of which are incorporated by reference in their entirety.

This invention relates generally to refiners for removing contaminants from fiber materials, such as recycled or recovered paper and packaging materials. In particular, the present invention relates to refiner stator plates and especially to the outer row of teeth on the stator plates.

Refiner plates are used for imparting mechanical work on fibrous material. Refiner plates having teeth (in contrast to plates having bars) are typically used in refiners which serve to deflake, disperge or mix fibrous materials with or without addition of chemicals. The refiner plates disclosed herein are generally applicable to all toothed plates for dispergers specifically and refiners in general.

Disperging is primarily used in de-inking systems to recover used paper and board for reuse as raw material for producing new paper or board. Disperging is used to detach ink from fiber, disperse and reduce ink and dirt particles to a favorable size for downstream removal, and reduce particles to sizes below visible detection. The disperger is also used to break down stickies, coating particles and wax (collectively referred to as "particles") that are often in the fibrous material fed to refiner. The particles are removed from the fibers by the disperger become entrained in a suspension of fibrous material and liquid flowing through the refiner, and are removed from the suspension as the particles float or are washed out of the suspension. In addition, the disperger may be used to mechanically treat fibers to retain or improve fiber strength and mix bleaching chemicals with fibrous pulp.

There are typically two types of mechanical dispergers used on recycled fibrous material: kneeders and rotating discs. This disclosure focuses on disc-typed disperger plates that have toothed refiner stator plates. Disc-type dispergers are similar to pulp and chip refiners. A refiner disc typically has mounted thereon an annular plate or an array of plate segments arranged as a circular disc. In a disc-type disperger, pulp is fed to the center of the refiner using a feed screw and moves peripherally through the disperging zone, which is a gap between the rotating (rotor) disk and stationary (stator) disk, and the pulp is ejected from the disperging zone at the periphery of the discs.

The general configuration of a disc-type disperger is two circular discs facing each other with one disc (rotor) being rotated at speeds usually up to 1800 ppm, and potentially higher speeds. The other disc is stationary (stator). Alternatively, both discs may rotate in opposite directions.

On the face of each disc is mounted a plate having teeth (also referred to as pyramids) mounted in tangential rows. A plate may be a single annular plate or an annular array of plate segments. Each row of teeth is typically at a common radius from the center of the disc. The rows of rotor and stator teeth interleave when the rotor and stator discs are opposite each other in the refiner or disperger. The rows of rotor and stator teeth intersect a plane in the disperging zone that is between the discs. Channels are formed between the interleaved rows of teeth. The channels define the disperging zone between the discs.

The fibrous pulp flows alternatively between rotor and stator teeth as the pulp moves through successive rows of rotor and stator teeth. The pulp moves from the center inlet of the disc to a peripheral outlet at the outer circumference of the discs. As fibers pass from rotor teeth to stator teeth and vice-versa, the fibers are impacted as the rows of rotor teeth rotate between rows of stator teeth. The clearance between rotor and stator teeth is typically on the order of 1 to 12 mm (millimeters). The fibers are not cut by the impacts of the teeth, but are severely and alternately flexed. The impacts received by the fiber break the ink and toner particles off of the fiber and into smaller particles, and break the stickie particles off of the fibers.

Two types of plates are commonly used in disc-type dispergers: (1) a pyramidal design (also referred to as a tooth design) having an intermeshing toothed pattern, and (2) a refiner bar design. A novel pyramidal tooth design has been developed for a refiner plate and is disclosed herein.

FIGS. 1*a*, 1*b* and 1*c* show an exemplary pyramidal plate segment having a conventional tooth pattern. An enhanced exemplary pyramidal toothed plate segment is shown in commonly-owned U.S. Patent Application Publication No. 2005/0194482, entitled "Grooved Pyramid Disperger Plate." For pyramidal plates, fiber stock is forced radially through small channels created between the teeth on opposite plates, as shown in FIG. 1*c*. Pulp fibers experience high shear, e.g., impacts, in their passage through dispergers caused by intense fiber-to-fiber and fiber-to-plate friction.

With reference to FIGS. 1*a*, 1*b* and 1*c*, the refiner or disperger 10 comprises disperger plates 14, 15 which are each securable to the face of one of the opposing disperger discs 12, 13. The discs 12, 13, only portions of which are shown in FIG. 1*c*, each have a center axis 19 about which they rotate, radii 32 and substantially circular peripheries.

A plate may or may not be segmented. A segmented plate is an annular array of plate segments typically mounted on a disperger disc. A non-segmented plate is a one-piece annular plate attached to a disperger disc. Plate segment 14 is for the rotor disc 12 and plate segment 15 is for the stator disc 13. The rotor plate segments 14 are attached to the face of rotor disc 12 in an annular array to form a plate. The segments may be fastened to the disc by any convenient or conventional manner, such as by bolts (not shown) passing through bores 17. The disperger plate segments 14, 15 are arranged side-by-side to form plates attached to the face of the each disc 12, 13.

Each disperger plate segment 14, 15 has an inner edge 22 towards the center 19 of its attached disc and an outer edge 24 near the periphery of its disc. Each plate segment 14, 15 has, on its substrate face concentric rows 26 of pyramids or teeth 28. The rotation of the rotor disc 12 and its plate segments 14 apply a centrifugal force to the refined material, e.g., fibers, that cause the material to move radially outward from the inner edge 22 to the outer edge 24 of the plates. The refined material predominantly move through the disperging zone channels 30 formed between adjacent teeth 28 of the opposing plate segments 14, 15. The refined material flows radially out from the disperging zone into a casing 31 of the refiner 10.

The concentric rows 26 are each at a common radial distance (see radii 32) from the disc center 19 and arranged to intermesh so as to allow the rotor and stator teeth 28 to intersect the plane between the discs. Fiber passing from the center of the stator to the periphery of the discs receive impacts as the rotor teeth 28 pass close to the stator teeth 28. The channel clearance between the rotor teeth 28 and the stator teeth 28 is on the order of 1 to 12 mm so that the fibers are not cut or pinched, but are severely and alternately flexed as they pass in the channels between the teeth on the rotor disc 12 and the teeth on the stator disc 13. Flexing the fiber breaks the ink and toner particles on the fibers into smaller particles and breaks off the stickie particles on the fibers.

FIGS. 2*a* and 2*b* show a top view and a side cross-sectional view, respectively, of a standard tooth geometry 34 used in the outer row of a stator plate. The tooth 34 has a pyramidal design consisting of strait sides 36 that taper to the top 38 of the tooth. The sides of the standard tooth 28 are each substantially parallel to a radial 32 of the plate.

A primary role of the disperger plate is to transfer energy pulses (impacts) to the fibers during their passage through the channels between the discs. The widely accepted toothed plate typically includes the square pyramidal tooth geometry with variations in edge length and tooth placement to achieve desired results.

Refiner material passing between the discs can be accelerated to a high velocity due to the centrifugal forces imparted by the rotor disc. Some of the refiner material exits the discs 12, 13 at a high velocity and are flung radially against the refiner casing 31. The high velocity impacts of refiner material against the casing have caused abrasive wear and damaging cavitation to the casing. There is a long felt need for a means to reduce the wear and damage on refiner and disperger casing due and, particularly, to reduce the wear and damage caused by refiner material impacts against the casing.

BRIEF DESCRIPTION

This disclosure proposes a modified stator tooth geometry, such as an angled tooth, for the outermost row of a stator plate. The modified tooth geometry is intended to achieve a longer life of the casing by reducing impacts against the casing due to high velocity particles exiting the plates of the refiner.

A refiner stator plate has been developed having a plurality of concentric rows of teeth wherein an outer row is at or near an outer periphery of the plate segment. The teeth in the outer row include leading sidewalls, wherein the sidewalls are at an angle to radii of the plate segment. plate is preferably a stator plate for a disperger. The angle of the sidewalls of the outer row may be opposite to a direction of rotation of a rotor plate. The angle of the sidewalls is in a range of 10 to 60 degrees with respect to a radial, and preferably in a range of 15 to 45 degrees. The sidewalls may be planar, V-shaped having a straight radial inward surface and a slanted radial outward surface, or curved along their lengths.

Further, the angled sidewall of the teeth of the outer stator row are arranged to project normal (in other words, tangential) to a radial a distance at least equal to a gap between adjacent teeth of the outer stator row. In addition, the angled sidewall may include an angled wall portion and a radially aligned wall portion. Further, the outer row of teeth may have substantially perpendicular rear walls.

A refiner or disperger has been developed comprising a rotor disc including a rotor plate including concentric rows of rotor teeth; a stator disc arranged opposite to the rotor disc in a disperger, wherein the stator disc includes a stator plate, wherein the stator plate includes concentric rows of stator teeth intermeshing with the rotor teeth and an outer row of the stator teeth include sidewalls angled in opposition to the rotation of the rotor disc so as to deflect particles flowing between the teeth of the outer row.

A method of refining pulp material between opposing discs in a refiner has been developed, the method comprising: feeding the pulp material to an inlet of at least one of the discs; rotating one disc with respect to the other disc while pulp material is moved between the discs due to centrifugal force; refining the pulp material by subjecting the material to impacts caused by rows of teeth on the rotating disc intermeshing with rows of teeth on the other disc; deflecting the pulp material as the material flows through an outer row of teeth on the other disc, wherein the outer row of discs comprise teeth having a sidewall angled to deflect pulp material moving radially between the teeth.

BRIEF DESCRIPTION OF THE DRAWINGS

FIG. 1(*c*) is a side cross-sectional view of a stator and rotor disperger plates and discs with channels therebetween.

DETAILED DESCRIPTION

A novel arrangement of teeth for a toothed refiner stator plate has been developed in which the outer peripheral row of teeth are angled to deflect refiner material, e.g., pulp, moving through the disperging zone. The deflection reduces the velocity of refiner material particles that would otherwise move along a radial line at a high speed from between the refiner discs and into the casing. This novel arrangement of outer row stator teeth may be applied to any type of toothed refiner plate and especially disc-type dispergers.

The outer row of stator teeth are angled to control the feed of the pulp exiting the disperging zone and out from between the discs. In particular, the leading sidewall of the stator teeth in the outer row of teeth are angled to slant the teeth so as to deflect particles moving along a substantially radial line between the outer row of stator teeth. Deflecting refiner material reduces the velocity of the exiting refiner material and minimizes the impact of the refiner material on the walls of the refiner casing.

The angled outer row of stator teeth prevent pulp from following a direct radial path from the last row of stator teeth and into the casing where high velocity pulp can damage the casing wall. The angle of the outer row of stator teeth and the length of the angled portion of these teeth are selected such that the refiner material, e.g. pulp, passing through the disperging zone is deflected by the angled sidewalls of the last row of stator teeth. The outer row teeth are slanted, at least along a portion of the teeth, such that the slanted portion of the teeth project tangentially a distance at least equal to the gap between adjacent teeth. The deflection prevents refiner materials from being flung at high velocity radially from the discs and into the refiner casing.

Figure 3A:
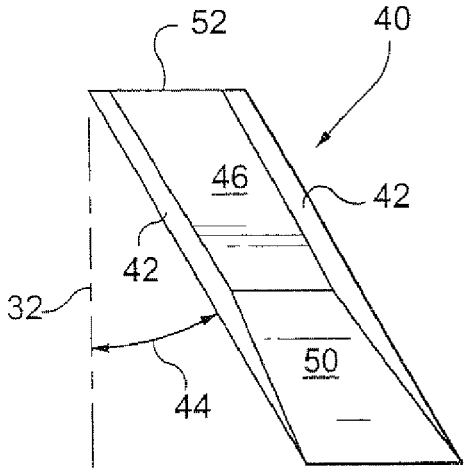
FIGS. 3*a* and 3*b* are a top down view and a side perspective view, respectively, of an angled tooth for the outer row of a stator disperger plate, wherein the sidewalls of the tooth are each angled with respect to a radius of the disc.
Figure 3B:
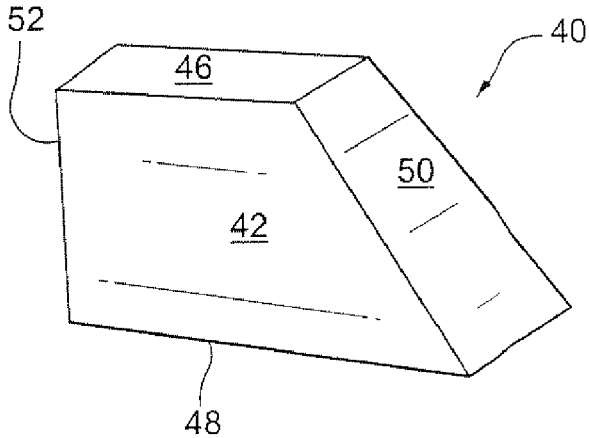

FIGS. 3*a* and 3*b* show a top view and a side perspective view, respectively, of an angled stator tooth 40 where the sides of the tooth are angled with respect to a radial 32 of the disc center. The stator tooth 40 is preferably positioned at the outer row of the stator plate. One or both of the sidewalls 42 of the tooth 40 form an angle 44 with respect to a radius 18 of the disc. Further, the sidewalls 42 taper towards the top 46 of the tooth. The base 48 of the tooth is at the substrate of the plate. The front wall 50 of the tooth faces radially inward and the rear wall 52 of the tooth faces radially outward. The front and rear faces may each be aligned substantially tangent to the row and plate. The front wall may slope towards the top of the tooth. The rear wall, preferably, is generally perpendicular to the substrate of the plate.

The slant (angle 44) of the outer row of stator teeth deflects refiner material as it passes through the outer row of stator teeth. The deflection is intended to slow the refiner material, pulp and entrained particles, as it leaves the channel between the disc and before the refiner material enters the casing of the disperger or refiner. By reducing the velocity of the refiner material, less damage is done to the casing as a result of refiner material hitting the casing.

Figure 4A:
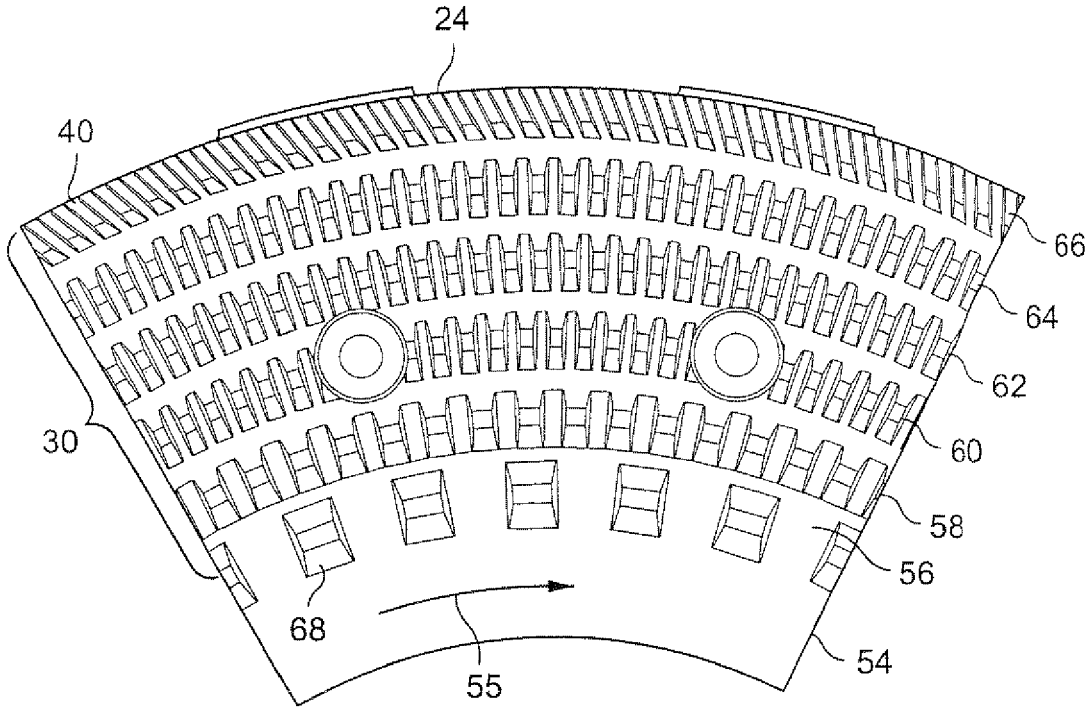
FIGS. 4*a* and 4*b* are a front plan view and a side cross-sectional view, respectively, of a disperging stator plate segment utilizing the angled tooth geometry for the outer row of teeth.
Figure 4B:
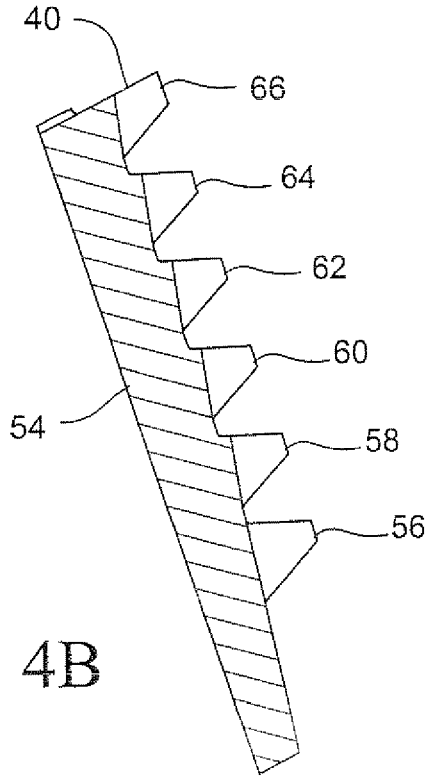

FIGS. 4*a* and 4*b* are a font view and a side-cross-sectional view, respectively, of an exemplary stator plate 54 that is mounted on a disperger disc. The stator plate is opposite a rotor plate and a disperging zone is formed by the channels between the two opposing plates. The rotational direction (arrow 55) for the rotor plate is counter-clockwise (which appears clockwise from the view point of FIG. 4*a* which shows a stator plate segment).

Figure 1A:
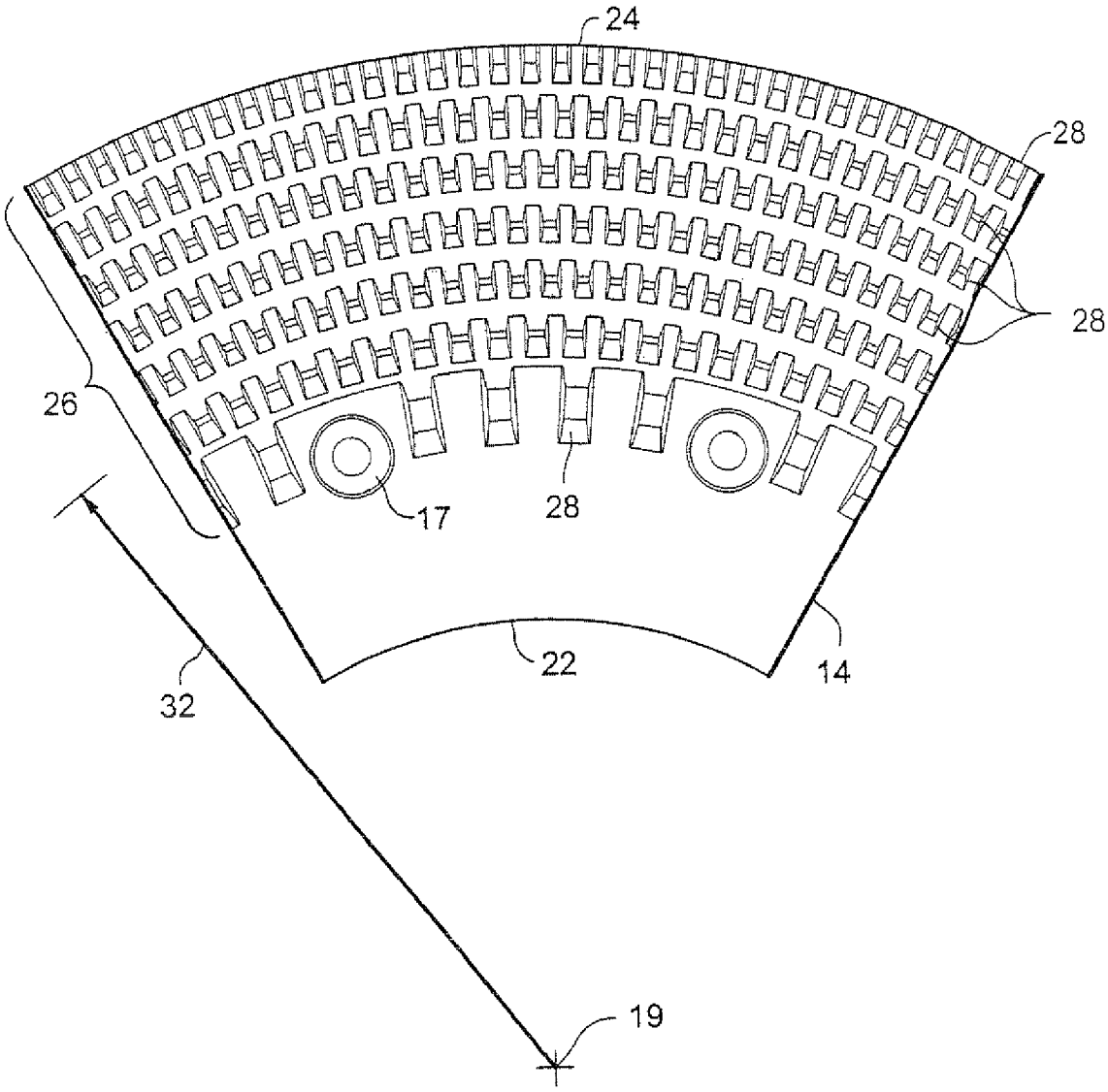
Fig. 1A (PRIOR ART)
FIGS. 1(*a*) and 1(*b*) are a front view and cross-sectional sectional side view, respectively, of a toothed stator plate segment conventionally used in disc-type dispergers.
Figure 1C:
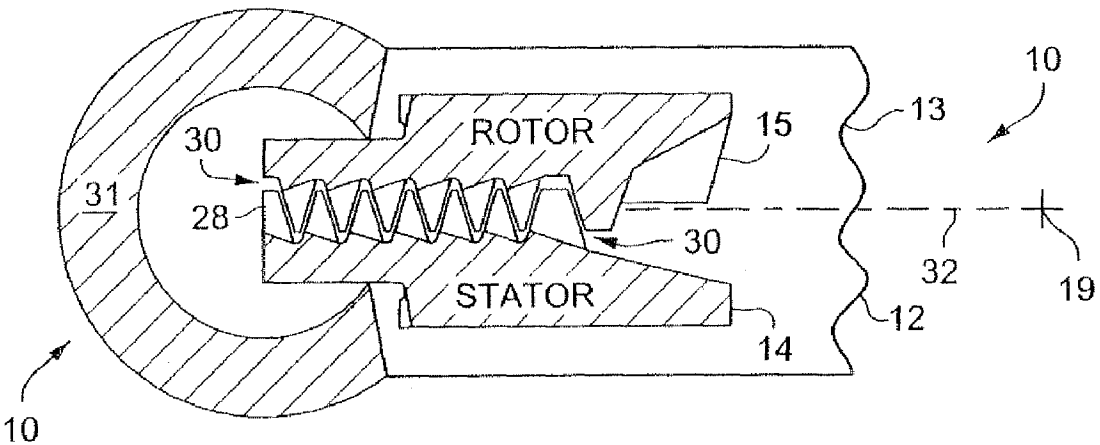
Fig. 1C (PRIOR ART)
Figure 1B:
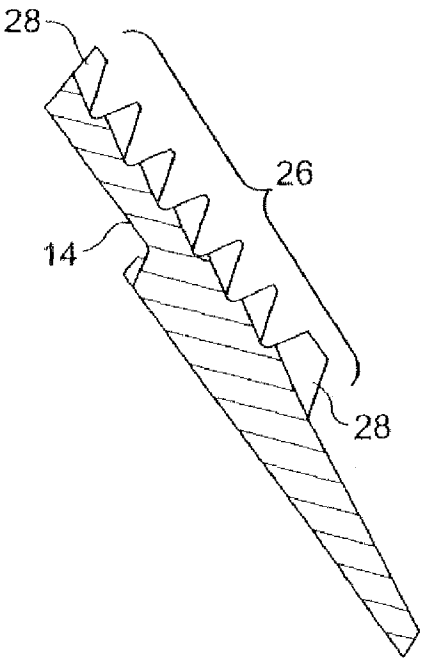
Fig. 1B (PRIOR ART)
Figure 2A:
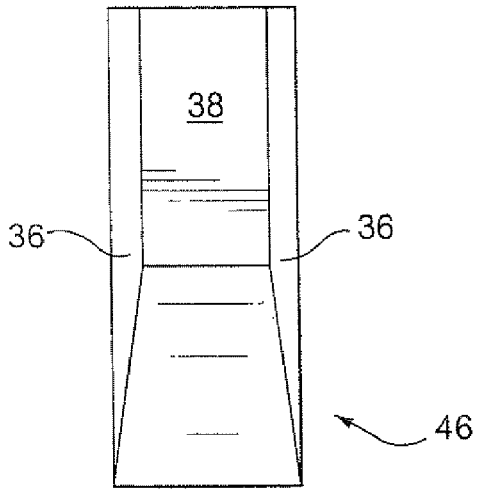
FIGS. 2*a* and 2*b* are a top down view and a side perspective view, respectively, of a conventional tooth geometry for the outer teeth row of stator disperger plate.
Figure 2B:
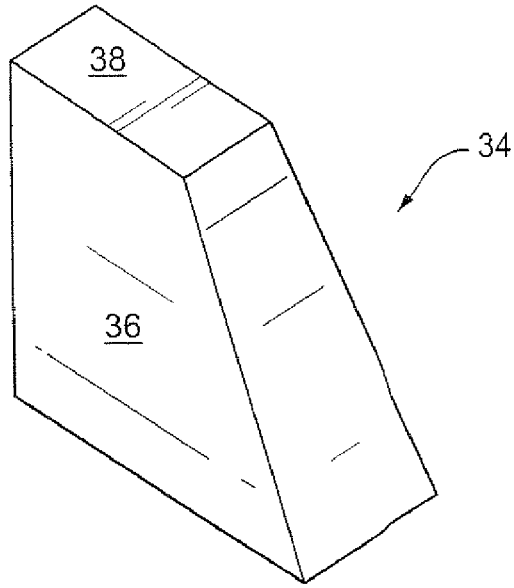

The stator disperger plate segment 54 includes rows 56, 58, 60, 62, 64 and 66 of teeth 68. The inner teeth rows (56, 58, 60, 62 and 64) may have a pyramidal shape such as shown in FIGS. 2*a* and 2*b*. The sidewalls of the inner rows of teeth may be aligned with a radius of the disc, or may be slanted with respect to the radius. Similarly, the rotor plate (not shown) may have rows of teeth that interleave with the row of stator teeth, when the plates are arranged in the refiner.

The outer row 66 of stator teeth 40 have sidewall angles that are angled either in the same direction as or opposite to the rotation 55 of the rotor. It should make no difference to casing protection whether the last row of stator teeth are slanted towards or against the rotational direction. Slanting the outer row of stator teeth in a direction opposite to direction places the teeth in a "holdback" position, and slanting the teeth in the same direction of rotation is a "feeding position." Further, the sidewall angle of the teeth 40 may be between 10° to 60°, and preferably in a range of 15° to 45°, with respect to a radial of the plate and disc. The angle (44 in FIG. 3*a*) of the sidewalls of the last row 66 of stator teeth 40 is selected to deflect refiner material moving through the row and to allow the flow without too much obstruction.

The rear wall (52 in FIG. 3*b*) extends to the outer periphery 24 of the stator plate. The sidewall of the teeth 40 are extended as a result of the rear wall being substantially normal to the substrate 72 of the stator plate 54. Extending the sidewalls provides additional sidewall area to deflect the refiner material. The length and angle of the sidewall should be sufficient such that a fast moving particle cannot move along a radial through the gap between the teeth without hitting the sidewall of a tooth. Accordingly, the projection of the width of the sidewall along a tangential direction should be at least as wide as the gap between the teeth of the last stator row.

The sidewalls on both sides of the outer row stator teeth 40 preferably form the same angles with respect to radii. The leading sidewall (facing the rotational direction of the rotor) deflects pulp. The trailing sidewall is on the opposite side of the tooth and faces a leading sidewall of an adjacent stator tooth. Maintaining the same angles on both sides of the teeth ensures that the gap between teeth remains constant along the length of the teeth. Accordingly, the leading and trailing sidewalls of the stator tooth are preferably symmetrical.

Figure 5:
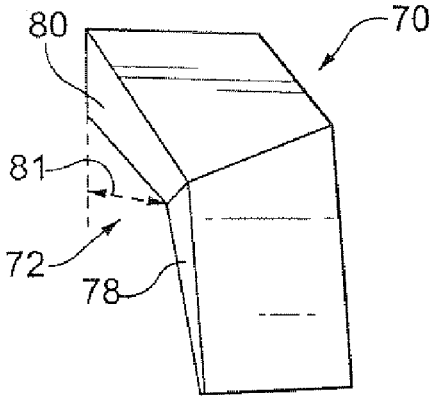
FIG. 5 is a top down perspective view of an alternative angled tooth geometry for an outer row of a stator plate.

FIG. 5 shows a top down perspective view of an alterative tooth 70 for the last row of the stator plate. The alterative tooth has a double angled sidewall 72 that includes a radial sidewall section 78 and an angled wall section 80. The radial sidewall section 78 is substantially aligned with a radial of the stator plate. The angled wall section 80 is offset from a radial by an angle 10 to 60 degrees and preferably between 15 to 45 degrees. The length and angle of the angled sidewall 80 are arranged to deflect all refined material moving along a radial and between teeth in the last row of stator teeth. In particular, the tangential projection 81 of the length of the sidewall 80 spans the width of the gap between adjacent teeth in the last stator row.

Figure 6:
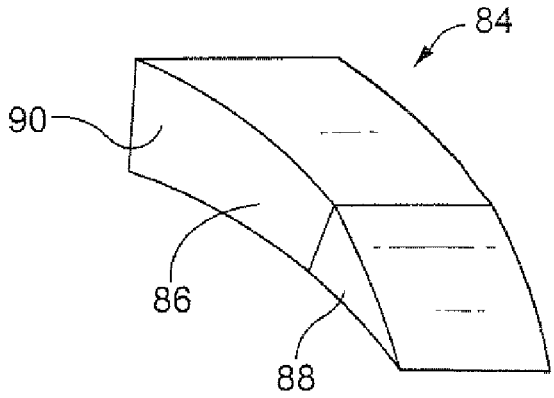
FIG. 6 is a top down perspective view of another alternative angled tooth geometry for an outer row of a stator plate.

FIG. 6 shows a top down perspective view of another alterative tooth 84 for the last row of the stator plate. The alterative tooth has a curved sidewall 86 that starts as a substantially radial sidewall section 88 and progressively turns to an angled wall section 90. The inward radial sidewall section 88 is substantially aligned with a radial of the stator plate. The length and curvature of sidewall 86 are arranged to deflect all refined material moving along a radial and between teeth in the last row of stator teeth. In particular, the tangential projection of the length of the sidewall 86 should span the width of the gap between adjacent teeth in the last stator row.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A refiner comprising:

a rotor disc including a rotor plate having concentric rows of rotor teeth;

a stator disc opposite to the rotor disc, wherein the stator disc includes a stator plate;

the stator plate includes concentric rows of stator teeth intermeshing with the rows of rotor teeth;

the rows of stator teeth include an outer row of stator teeth having leading sidewalls angled to deflect particles flowing between the teeth of the outer row, and the rows of stator teeth include an inner row of stator teeth that are radially inward of and adjacent the outer row, wherein the stator teeth in the inner rows have leading sidewalk parallel to a radius of the stator plate.

2. The refiner of claim 1 wherein the refiner is a disperger.

3. The refiner of claim 1 wherein the leading sidewalls of the outer row of stator teeth form an angle in a range of 10 to 60 degrees with respect to a radial of the plate.

4. The refiner plate of claim 1 wherein the leading sidewalls of the outer row of stator teeth form an angle in a range of 15 to 45 degrees with respect to a radial of the plate.

5. The refiner plate of claim 1 wherein the leading sidewalls of the outer row of stator teeth have a surface shape of at least one of: planar, V-shaped including a radial inward surface and a slanted outward surface, and a curved section.

6. The refiner plate of claim 1 wherein the leading sidewalls of the outer row of stator teeth have a length including a tangential dimension extending a distance at least equal to a gap between adjacent teeth of the outer stator row.

7. The refiner plate of claim 1 wherein the leading sidewalls of the outer row of stator teeth each include an angled wall portion and a radially aligned wall portion, wherein the angled wall portion is radially outward of the radially aligned wall portion.

8. The refiner plate of claim 1 wherein the teeth of the outer row each have a trailing wall substantially perpendicular to a trailing sidewall of each tooth.

9. A refiner comprising:

a first disc including a first plate;

a second disc opposite to the first disc and including a second plate comprising teeth intermeshing with teeth on the first plate;

the teeth on the second plate include an outer row of teeth, wherein each tooth has a leading sidewall angled to deflect particles flowing between the teeth of the outer row, and the rows of stator teeth include an inner row of stator teeth that are radially inward of and adjacent to the outer row, wherein. the stator teeth in the inner row have leading sidewalls parallel to a radius of the stator plate.

10. A refiner as in claim 9 wherein the second disc is a stationary stator disc.

11. A refiner as in claim 9 wherein the outer row of teeth is an outermost row of teeth on the stator plate.

* * * * *